US010693212B2

(12) United States Patent
Su

(10) Patent No.: US 10,693,212 B2
(45) Date of Patent: Jun. 23, 2020

(54) MONOPOLE ANTENNA

(71) Applicant: ASUSTeK COMPUTER INC., Taipei (TW)

(72) Inventor: Saou-Wen Su, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 14 days.

(21) Appl. No.: 16/120,575

(22) Filed: Sep. 4, 2018

(65) Prior Publication Data

US 2019/0081384 A1 Mar. 14, 2019

(30) Foreign Application Priority Data

Sep. 12, 2017 (TW) ..... 106131305 A

(51) Int. Cl.
*H01Q 1/48* (2006.01)
*H01Q 1/22* (2006.01)
(Continued)

(52) U.S. Cl.
CPC ..... *H01Q 1/2266* (2013.01); *H01Q 1/243* (2013.01); *H01Q 1/48* (2013.01); *H01Q 5/328* (2015.01); *H01Q 5/371* (2015.01); *H01Q 9/42* (2013.01)

(58) Field of Classification Search
CPC ..... H01Q 1/2266; H01Q 1/22; H01Q 1/24; H01Q 1/243; H01Q 1/38; H01Q 1/48;
(Continued)

(56) References Cited

U.S. PATENT DOCUMENTS 4,661,821 A * 4/1987 Smith ..... H01Q 9/065 343/743
7,768,466 B2 * 8/2010 Chi ..... H01Q 9/26 343/700 MS
(Continued)

FOREIGN PATENT DOCUMENTS

| | | |
|---|---|---|
| TW | 1506851 | 11/2015 |
| TW | 1536669 B | 6/2016 |
| TW | 1581508 B | 5/2017 |

OTHER PUBLICATIONS

Office Action issued in corresponding Taiwan patent application dated Dec. 10, 2018 (and its partial English translation).

*Primary Examiner* — Tho G Phan
(74) *Attorney, Agent, or Firm* — McClure, Qualey & Rodack, LLP.

(57) ABSTRACT

A monopole antenna is provided. The monopole antenna comprises a ground element, a radiating element, a first inductive element and a second inductive element. The radiating element includes a feed point and the feed point divides the radiating element into the first radiating portion and the second radiating portion. The second radiating portion is connected with the first radiating portion. The first radiating portion and the second radiating portion support a first frequency band and a second frequency band, respectively. The operating frequency of the first frequency band is higher than that of the second frequency band. The first inductive element is connected between the first radiating portion and the ground element. The second inductive element is connected between the second radiating portion and the ground element.

10 Claims, 10 Drawing Sheets

(51) Int. Cl.

| | |
|---|---|
| ***H01Q 5/371*** | (2015.01) |
| ***H01Q 9/42*** | (2006.01) |
| ***H01Q 1/24*** | (2006.01) |
| ***H01Q 5/328*** | (2015.01) |

(58) Field of Classification Search
CPC ..... H01Q 5/32; H01Q 5/328; H01Q 5/37; H01Q 5/371; H01Q 9/42
See application file for complete search history.

(56) References Cited

U.S. PATENT DOCUMENTS

| | | | | |
|---|---|---|---|---|
| 9,166,279 | B2 * | 10/2015 | Jin | H01Q 1/243 |
| 9,343,812 | B2 * | 5/2016 | Wong | H01Q 7/00 |
| 9,350,069 | B2 | 5/2016 | Pascolini et al. | |
| 9,531,061 | B2 * | 12/2016 | Han | H01Q 1/243 |
| 2014/0015729 | A1 | 1/2014 | Uejima et al. | |
| 2015/0249292 | A1 * | 9/2015 | Ouyang | H01Q 21/30 343/702 |

* cited by examiner x-z plane x-y plane y-z plane x-z plane x-y plane y-z plane

MONOPOLE ANTENNA

CROSS-REFERENCE TO RELATED APPLICATION

This application claims the priority benefit of Taiwan application serial No. 106131305, filed on Sep. 12, 2017. The entirety of the above-mentioned patent application is hereby incorporated by reference herein and made a part of specification.

BACKGROUND OF THE INVENTION

Field of the Invention

The disclosure relates to a monopole antenna.

Description of the Related Art

With light, thin, and portable trends of mobile devices, notebook computers are designed with narrow-bezel screens. Due to the narrow bezel width, the antenna clearance area is greatly reduced, so that the antenna with a traditional standard size has difficult to fit in the space around the screen of a notebook computer with the narrow bezel.

BRIEF SUMMARY OF THE INVENTION

According to one aspect of the disclosure, a monopole antenna is provided. The monopole antenna comprises: a ground element, including a side; a radiating element, supporting a first frequency band and a second frequency band and the operating frequency of the first frequency band is higher than the operating frequency of the second frequency band, the radiating element including: a first radiating portion, supporting the first frequency band, wherein the first radiating portion extends along the side and the first radiating portion is separated from the side by a first distance; a second radiating portion, supporting the second frequency band, wherein the second radiating portion is connected to the first radiating portion and extends along the side, the length of the second radiating portion is greater than the length of the first radiating portion, and the second radiating portion is separated from the side by a second distance; and a feed point, dividing the radiating element into the first radiating portion and the second radiating portion; a first inductive element, connected between the first radiating portion and the ground element; and a second inductive element, connected between the second radiating portion and the ground element.

DETAILED DESCRIPTION OF THE EMBODIMENTS

Figure 1:
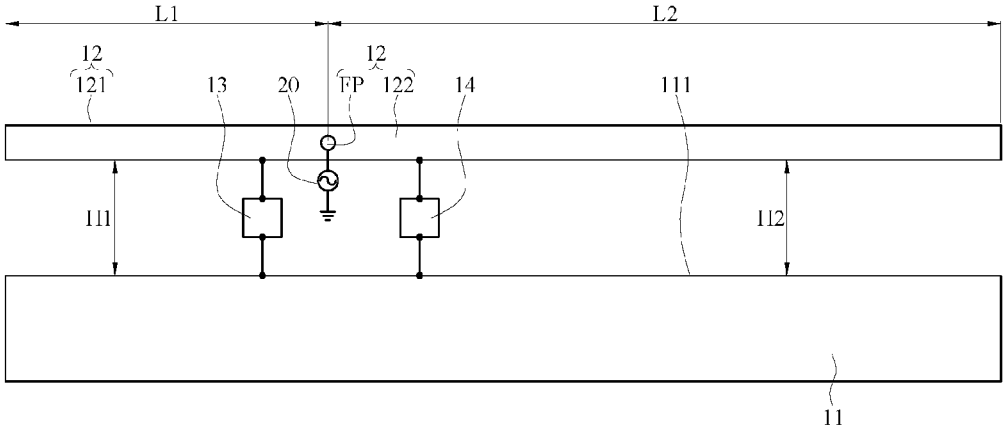
FIG. 1 to FIG. 3 are schematic diagrams showing a monopole antenna in a first embodiment.
Figure 2:
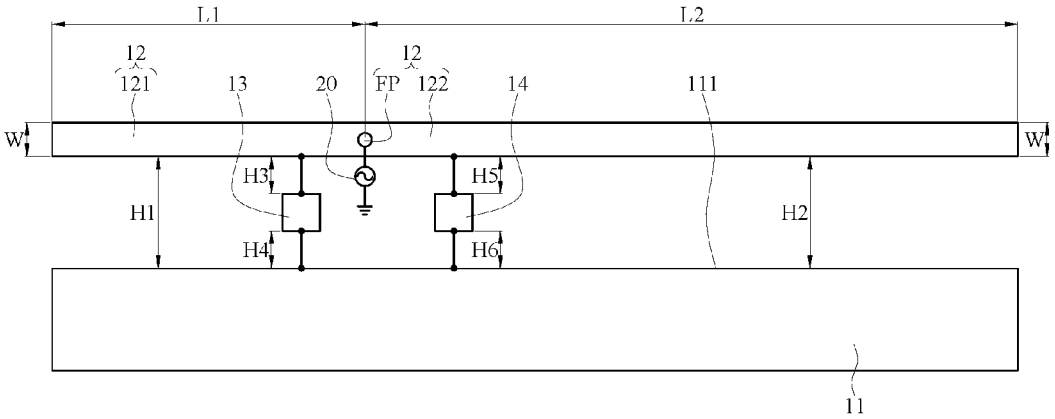
Figure 3:
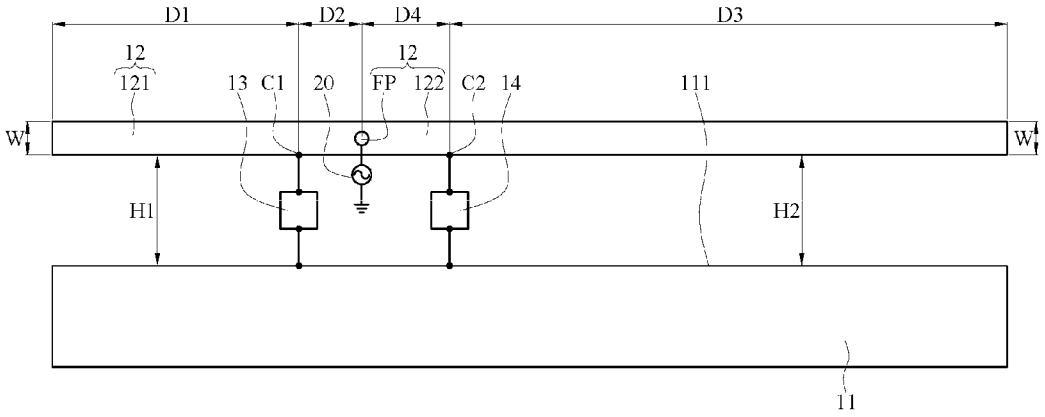

Referring to FIG. 1 to FIG. 3, a monopole antenna includes a ground element 11, a radiating element 12, a first inductive element 13, and a second inductive element 14. In an embodiment, the radiating element 12 is made of a conductor or a metal material such as copper, silver, aluminum, iron, or an alloy thereof. The ground element 11 is a separate metal plate or a metal plane attached to a circuit board. In one embodiment, the ground element 11 is attached to a screen protection metal frame of a notebook computer, or attached to an electromagnetic interference (EMI) aluminum foil or sputtered layer in a notebook computer screen enclosure. The size of the ground element 11 is only an illustration, and the size of the ground element 11 differs depending on the application of the monopole antenna.

The ground element 11 includes a side 111. The radiating element 12 extends along the side 111 of the ground element 11. The length direction of the radiating element 12 is parallel to the side 111, and the radiating element 12 is separated from the side 111 by a distance. The radiating element 12 is provided with a feed point FP coupled to the signal source 20. The feed point FP divides the radiating element 12 into two parts. As shown in FIG. 1, the radiating element 12 includes a first radiating portion 121 and a second radiating portion 122 connected to each other, and the first radiating portion 121 has a length L1 smaller than a length L2 of the second radiating portion 122. The first radiating portion 121 extends along the side 111, and the length direction of the first radiating portion 121 is parallel to the side 111 of the ground element 11. The first radiating portion 121 is separated from the side 111 of the ground element 11 by a first distance H1. The second radiating portion 122 extends along the side 111. The length direction of the second radiating portion 122 is parallel to the side 111 of the ground element 11, and the second radiating portion 122 is separated from the side 111 of the ground element 11 by a second distance H2. The second distance H2 is substantially equal to the first distance H1.

The first inductive element 13 is disposed between the first radiating portion 121 and the ground element 11. One end of the first inductive element 13 is connected with the first radiating portion 121. The other end of the first inductive element 13 is connected with the side 111 of the ground element 11. The second inductive element 14 is disposed between the second radiating portion 122 and the ground element 11. One end of the second inductive element 14 is connected with the second radiating portion 122. The other end of the second inductive element 14 is connected with the side 111 of the ground element 11.

Based on the foregoing structure, regarding the operating frequency band, the first radiating portion 121 supports the first frequency band with a higher frequency (the length of the first radiating portion 121 does not exceed ⅕ wavelength of the resonant mode in the first frequency band), and the first inductive element 13 provides good impedance matching therein. The first inductive element 13 optimizes the operating frequency and bandwidth of the resonant mode generated by the first radiating portion 121. The second radiating portion 122 supports the second frequency band with a relatively lower frequency (the length of the second radiating portion 122 does not exceed ⅕ wavelength of the resonant mode in the second frequency band), and the second inductive element 14 provides good impedance matching therein. The second inductive element 14 optimizes the operating frequency and the bandwidth of the resonant mode generated by the second radiating portion 122. When the signal provided by the signal source 20 is fed from the feed point FP, the first radiating portion 121 is excited to generate an optimized resonant mode in the first frequency band, and the second radiating portion 122 is excited to generate the optimized resonant mode in the second frequency band.

As shown in FIG. 2 and FIG. 3, the designer of the monopole antenna utilizes the following parameters: the length L1, L2 and the width W of the two radiating portions 121, 122, the distance H1, H2 between the radiating element 12 and the ground element 11, the distances H3, H5 between the two inductive elements 13, 14 and the radiating element 12, the distance H4, H6 between the two inductive elements 13, 14 and the ground element 11, the inductance of the two inductive elements 13, 14, the distance D2 (hereinafter referred to as the fourth distance D2) between the vertical projection of the first connecting point C1 where the first inductive element 13 and the first radiating portion 121 connect with each other and the vertical projection of the feed point FP, the distance D4 (hereinafter referred to as the sixth distance D4) between the vertical projection of the second connecting portion C2 where the second inductive element 14 and the second radiating portion 122 connect with each other and the vertical projection of the feed point FP, the distance D1 (hereinafter referred to as the third distance D1) between the first connecting point C1 and one end of the first radiating portion 121 away from the feed point FP, and the distance D3 (hereinafter referred to as the fifth distance D3) between the second connecting point C2 and one end of the second radiating portion 122 away from the feed point FP, which make the first radiating portion 121 and the second radiating portion 122 generate resonant mode in the first frequency band and the second frequency band to conform the requirement.

Figure 4:
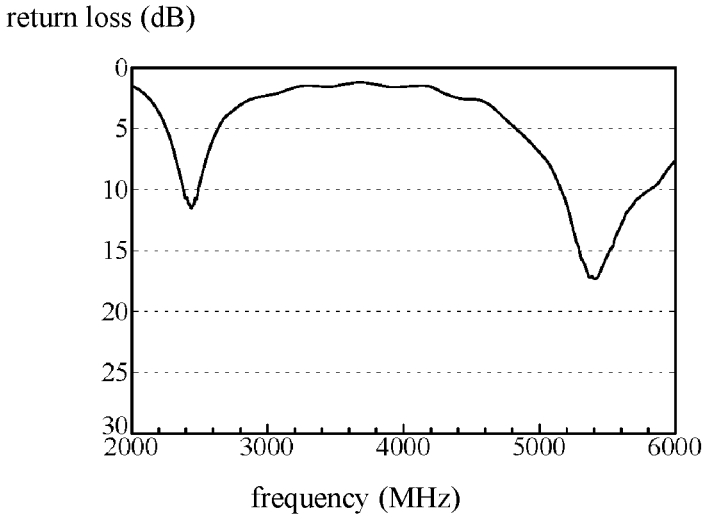
FIG. 4 is a return loss diagram of a monopole antenna in the first embodiment.

In an embodiment, the length L1 of the first radiating portion 121 is in the range of 8 to 10 mm (preferably 9 mm). The length L2 of the second radiating portion 122 is in the range of 20 to 22 mm (preferably 21 mm). The width W of the two radiating portions 121 and 122 is in the range of 0.5 to 1.5 mm (preferably 1 mm). The first distance H1 and second distance H2 are in the range of 3 to 4 mm (preferably 3 mm). The distance H3, H4, H5, H6 are in the range of 1 to 1.5 mm (preferably 1 mm). The distance D2 is smaller than the distance D1, the distance D2 is in the range of 0.5 to 1.5 mm (preferably 1 mm), the distance D4 is smaller than the distance D3, and the distance D3 is in the range of 1 to 3 mm (preferably 2 mm). The first inductive element 13 has an inductance of 3.6-5.6 nH (preferably 4.7 nH) and the second inductive element 14 has an inductance of 4.3-6.8 nH (preferred inductance is 5.6 nH). Please refer to FIG. 4. FIG. 4 is a diagram illustrating a return loss of the monopole antenna in the foregoing embodiment, the horizontal axis represents the operating frequency (MHz) and the vertical axis represents the return loss (dB). As shown in FIG. 4, the operating frequency of the monopole antenna includes a first frequency band in the range of 5000 MHz to 6000 MHz, and includes a second frequency band in the range of 2400 MHz to 2500 MHz. The monopole antenna is applied in computer devices with Bluetooth communication and/or Wi-Fi communication in an embodiment, and the monopole antenna has a width of only 4 mm, which meets the requirement for a narrow-bezel size between 4 mm and 6 mm in computer devices. Furthermore, the length of the monopole antenna is only 30 mm. The monopole antenna can also support multi-antenna system with multi-input multi-output (MIMO).

Figure 5:
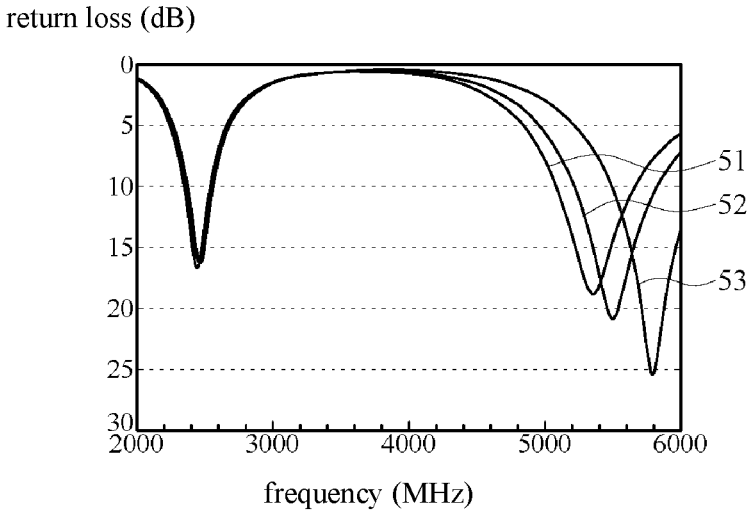
FIG. 5 is a return loss comparison diagram of monopole antennas with different fourth distances.

In one embodiment, different distances D2 affect the resonant mode generated by the first radiating portion 121 and changes the operating frequencies included in the first frequency band. In the embodiment, the first frequency band at least includes an operating frequency of 5 GHz and the length L1 of the first radiating portion 121 is 9 mm, the distance D2 is within the range of 0.5 mm to 1.5 mm. Referring to FIG. 5, FIG. 5 is a return loss comparison diagram of the monopole antennas with different distances D2. Curves 51, 52, and 53 correspond to the return loss of operating frequency of the monopole antenna with distance D2 of 0.5 mm, 1 mm, and 1.5 mm, respectively. As shown in FIG. 5, when the distance D2 is larger, the operating frequency included in the first frequency band is higher, and when the distance D2 is smaller, the operating frequency included in the first frequency band is lower. In one embodiment, the distance D2 is adjusted to make the first radiating portion 121 to generate a resonant mode in the first frequency band that meets the requirement.

Figure 6:
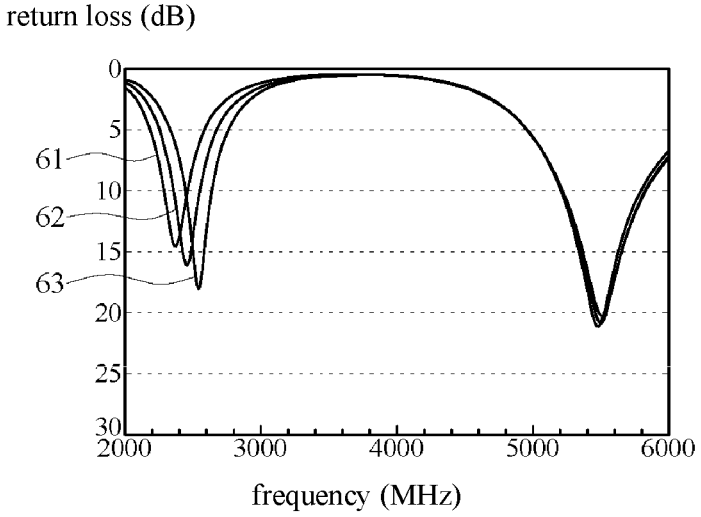
FIG. 6 is a return loss comparison diagram of monopole antennas with different sixth distances.

Furthermore, different distances D4 affect the resonant mode generated by the second radiating portion 122 and change the operating frequencies included in the second frequency band. In one embodiment, the second frequency band at least includes an operating frequency of 2.4 GHz and the length L2 of the second radiating portion 122 is 21 mm, the distance D4 is within the range of 1 mm to 3 mm. Referring to FIG. 6, FIG. 6 is a return loss comparison diagram of monopole antennas with different distances D4. Curves 61, 62, and 63 correspond to the return loss of operating frequency of the monopole antenna with distance D4 of 1 mm, 2 mm, and 3 mm, respectively. As shown in FIG. 6, when the distance D4 is larger, the operating frequency of the second frequency band is higher. When the distance D4 is smaller, the operating frequency of the second frequency band is lower. In one embodiment, the distance D4 is adjusted to make the second radiating portion 122 to generate a resonant mode in the second frequency band that meets the requirement.

Figure 7:
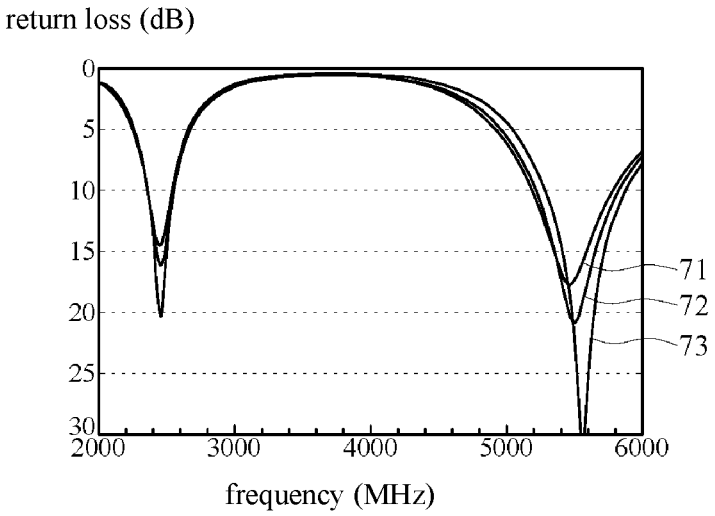
FIG. 7 is a return loss comparison diagram of monopole antennas having the first inductive elements with different inductance values.

In an embodiment, different inductance values of the first inductive element 13 affect the resonant mode generated by the first radiating portion 121, and change the return loss values corresponding to the operating frequencies included in the first frequency band. In the embodiment, the first frequency band contains at least an operating frequency of 5 GHz, and the inductance value of the first inductive element 13 is within the range of 3.6 nH to 5.6 nH. Referring to FIG. 7, FIG. 7 is a return loss comparison diagram of the monopole antenna having the first inductive element 13 with different inductance values, wherein the curves 71, 72, and 73 correspond to the return loss of operating frequency of the monopole antennas with the first inductive element 13 having a inductance value of 5.6 nH, 4.7 nH, 3.6 nH, respectively. As shown in FIG. 7, when the inductance value of the first inductive element 13 is smaller, the return loss value corresponding to the operating frequency included in the first frequency band is higher, and when the inductance value of the first inductive element 13 is larger, the return loss value corresponding to the operating frequency included in the first frequency band is lower. In one embodiment, the inductance value of the first inductive element 13 is adjusted to make the first radiating portion 121 to generate an impedance matching in the first frequency band that meets the requirement.

Figure 8:
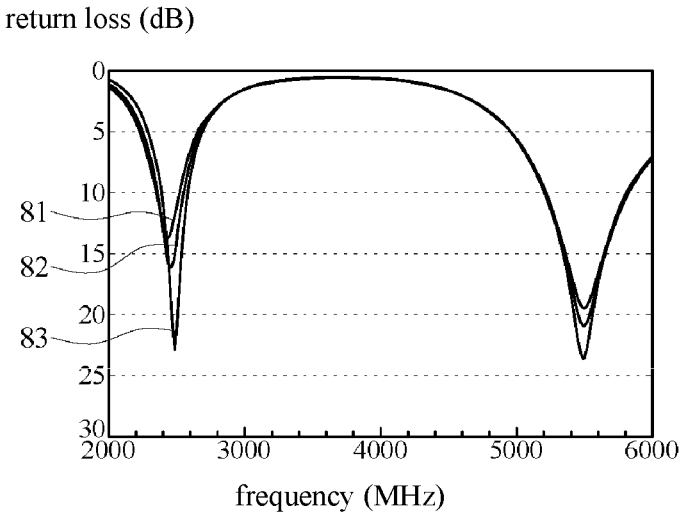
FIG. 8 is a return loss comparison diagram of monopole antennas having the second inductive elements with different inductance values.

Furthermore, different inductance values of the second inductive element 14 affect the resonant mode generated by the second radiating portion 122, and change the return loss value corresponding to the operating frequency included in the second frequency band. In one embodiment, the second frequency band contains an operating frequency of 2.4 GHz, and the inductance value of the second inductive element 14 is within the range of 4.3 nH to 6.8 nH. Referring to FIG. 8, FIG. 8 is a return loss comparison diagram of the monopole antennas having the second inductive element 14 with different inductance values, wherein the curves 81, 82, and 83 correspond to the return loss of operating frequency of the monopole antenna with the second inductive element 14 having a inductance value of 6.8 nH, 5.6 nH, 4.3 nH, respectively. As shown in FIG. 8, when the inductance value of the second inductive element 14 is larger, the return loss value corresponding to the operating frequency included in the second frequency band is lower, and when the inductance value of the second inductive element 14 is smaller, the return loss value corresponding to the operating frequency included in the second frequency band is higher. In one embodiment, the inductance value of the second inductive element 14 is adjusted to make the second radiating portion 122 to generate an impedance match in the second frequency band that meets the requirement.

Figure 9:
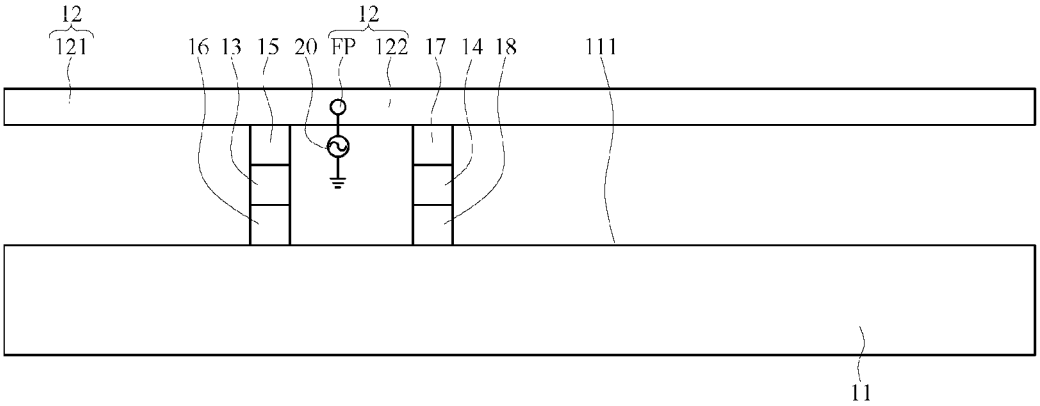
FIG. 9 is a schematic diagram showing monopole antennas in another embodiment.

In an embodiment, the first inductive element 13 is fixed between the first radiating portion 121 and the ground element 11 by welding. Referring to FIG. 9, FIG. 9 is a schematic diagram showing monopole antennas in another embodiment. A connecting element 15 formed of solder is further disposed between the first inductive element 13 and the first radiating portion 121, and a connecting element 16 formed by soldering is disposed between the first inductive element 13 and the ground element 11 to increase the connection strength between the first inductive element 13 and the first radiating portion 121 and the ground element 11. Similarly, the second inductive element 14 is fixed between the second radiating portion 122 and the ground element 11 by welding. As shown in FIG. 9, a connecting element 17 formed of solder is further disposed between the second inductive element 14 and the second radiating portion 122 and a connecting element 18 formed by soldering is further disposed between the second inductive element 14 and the ground element 11 to increase the connection strength between the second inductive element 14 and the second radiating portion 122 and the ground element 11.

Figure 10:
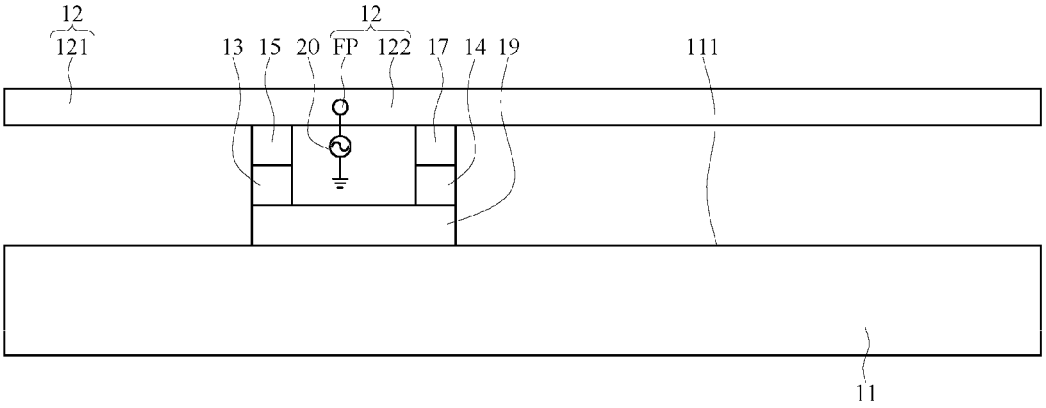
FIG. 10 is a schematic diagram showing a monopole antenna in a third embodiment.

Please refer to FIG. 10. In an embodiment, the monopole antenna further includes a connecting element 19. The connecting element 19 is made of a conductor or a metal material. The connecting element 19 is disposed between the first inductive element 13 and the ground element 11 and between the second inductive element 14 and the ground element 11. The connecting element 19 extends along the length direction of the radiating element 12. The connecting element 19 is connected with the first inductive element 13 and the second inductive element 14. In an embodiment, when the monopole antenna is applied to a notebook computer, the connecting element 19 is attached to the ground element 11 as an aluminum foil for electromagnetic interference prevention. That is, the ground element 11 is connected with the monopole antenna via the connecting element 19 connecting to the inductive element 13, 14. In addition, the signal transmission line between the signal source 20 and the feed point FP is soldered to between the feed point FP and connecting element 19.

Figure 11A:
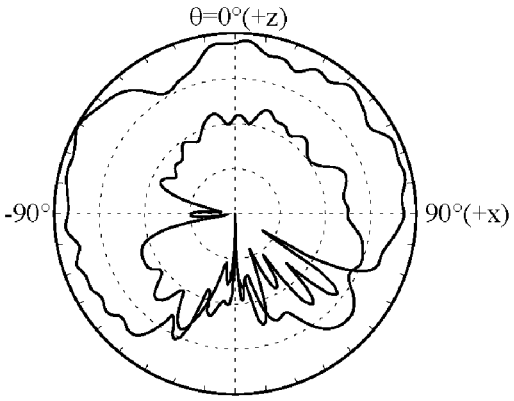
FIG. 11A is a radiation pattern diagram in the X-Z plane when a monopole antenna operates in a first frequency band in an embodiment.
Figure 11B:
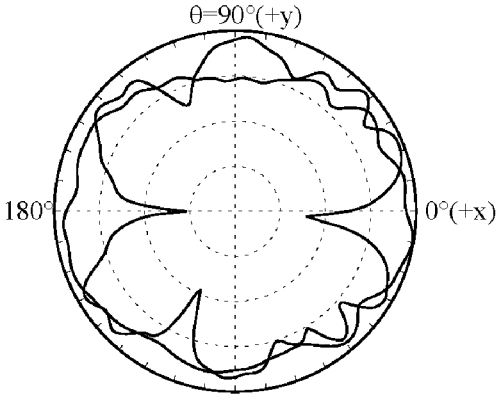
FIG. 11B is a radiation pattern diagram in the X-Y plane when a monopole antenna operates in a first frequency band in an embodiment.
Figure 11C:
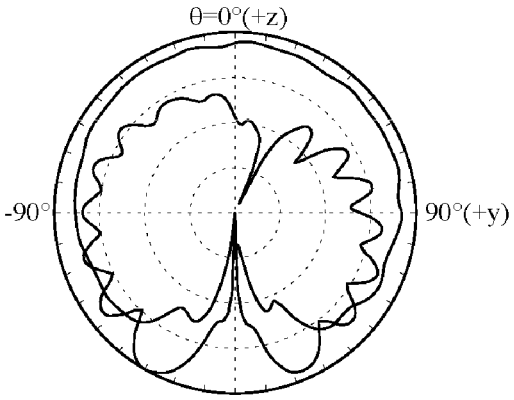
FIG. 11C is a radiation pattern diagram in the Y-Z plane when a monopole antenna operates in a first frequency band in an embodiment.
Figure 12A:
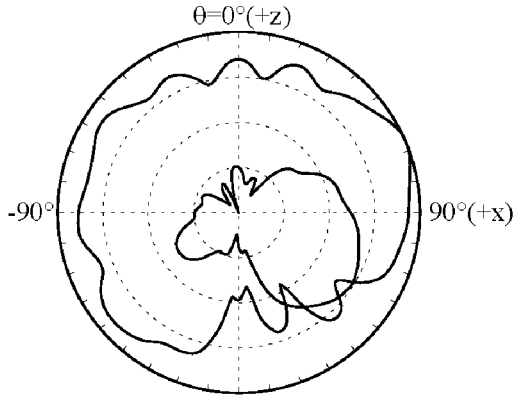
FIG. 12A is a radiation pattern diagram in the X-Z plane when a monopole antenna operates in a second frequency band in an embodiment.
Figure 12B:
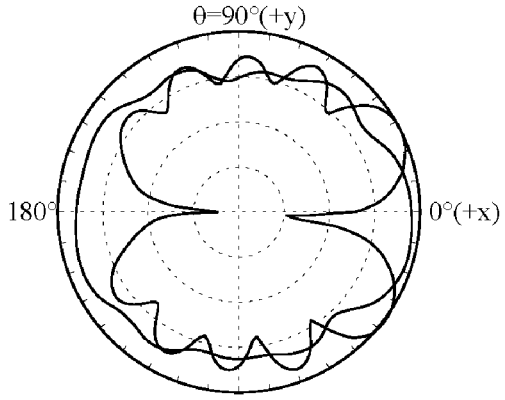
FIG. 12B is a radiation pattern diagram in the X-Y plane when a monopole antenna operates in a second frequency band in an embodiment.
Figure 12C:
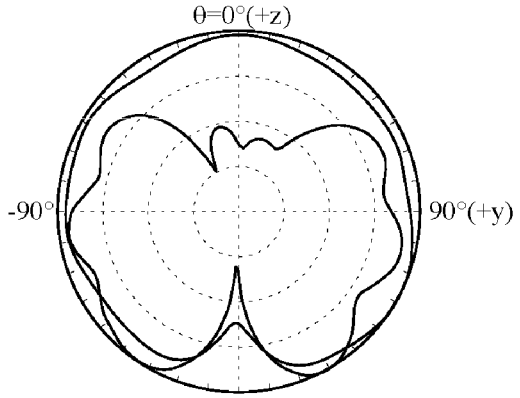
FIG. 12C is a radiation pattern diagram in the Y-Z plane when a monopole antenna operates in a second frequency band in an embodiment.

FIG. 11A to FIG. 11C are radiation pattern diagrams in the X-Z plane, the X-Y plane, and the Y-Z plane, respectively, when the monopole antenna operating in the first frequency band in an embodiment. FIG. 12A to FIG. 12C are radiation pattern diagrams in the X-Z plane, the X-Y plane, and the Y-Z plane, respectively, when the monopole antenna operating in the second frequency band in an embodiment. As shown in FIG. 11A to FIG. 11C and FIG. 12A to FIG. 12C, for the first frequency band or the second frequency band, the monopole antenna generates an omnidirectional radiation pattern in the X-Y plane, and the monopole antenna provides good communication quality.

In summary, according to an embodiment of the monopole antenna, the monopole antenna includes two asymmetrical radiating portions, and the monopole antenna includes two inductive elements for adjusting impedance matching. Thus, the monopole antenna has a width of only 4 mm, and the monopole antenna is significantly smaller in size than a conventional standard size antenna. The monopole antenna is built in narrow bezels of a notebook computer screen and can be applied to multiple input multiple output antenna unit architecture.

Although the present invention has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. A monopole antenna, comprising:

a ground element, including a side;

a radiating element, supporting a first frequency band and a second frequency band, and the operating frequency of the first frequency band is higher than the operating frequency of the second frequency band, the radiating element comprising:

a first radiating portion, supporting the first frequency band and extending along the side, and the first radiating portion is separated from the side by a first distance;

a second radiating portion, supporting the second frequency band, the second radiating portion connects the first radiating portion and extends along the side, the length of the second radiating portion is greater than the length of the first radiating portion, and the second radiating portion is separated from the side by a second distance; and a feed point, dividing the radiating element into the first radiating portion and the second radiating portion;

a first inductive element, connected between the first radiating portion and the ground element;

a second inductive element, connected between the second radiating portion and the ground element; and a connecting element disposed between the first inductive element and the ground element, and disposed between the second inductive element and the ground element, the connecting element extends along the side and connects with the ground element, the first inductive element and the second inductive element.

2. The monopole antenna according to claim 1, wherein the length direction of the radiating element is parallel to the side.

3. The monopole antenna according to claim 2, wherein a third distance is between one end of the first radiating portion away from the feed point and a first connecting point connected with the first inductive element and the first radiating portion, a fourth distance is between the first connecting point and the feed point, and the fourth distance is smaller than the third distance.

4. The monopole antenna according to claim 3, wherein the fourth distance is in the range of 0.5 mm to 1.5 mm.

5. The monopole antenna according to the claim 3, wherein a fifth distance is between one end of the second radiating portion away from the feed point and a second connecting point connected with the second inductive element and the second radiating portion, a sixth distance is between the second connecting point and the feed point, and the sixth distance is smaller than the fifth distance.

6. The monopole antenna according to the claim 5, wherein the sixth distance is in the range of 1 mm to 3 mm.

7. The monopole antenna according to the claim 1, wherein the length of the first radiating portion is 8~10 mm, and the length of the second radiating portion is 20~22 mm.

8. The monopole antenna according to the claim 1, wherein the width of the first radiating portion and the second radiating portion is 0.5-1.5 mm, and the first distance and the second distance are 3-4 mm.

9. The monopole antenna according to the claim 1, wherein the inductance of the first inductive element is in the range of 3.6 nH to 5.6 nH, and the inductance of the second inductive element is in the range of 4.3 nH to 6.8 nH.

10. A monopole antenna, comprising:

a ground element, including a side;

a radiating element, supporting a first frequency band and a second frequency band, and the operating frequency of the first frequency band is higher than the operating frequency of the second frequency band, the radiating element comprising:

a first radiating portion, supporting the first frequency band and extending along the side, and the first radiating portion is separated from the side by a first distance;

a second radiating portion, supporting the second frequency band, the second radiating portion connects the first radiating portion and extends along the side, the length of the second radiating portion is greater than the length of the first radiating portion, and the second radiating portion is separated from the side by a second distance; and a feed point, dividing the radiating element into the first radiating portion and the second radiating portion;

a first inductive element, connected between the first radiating portion and the ground element; and a second inductive element, connected between the second radiating portion and the ground element;

wherein a third distance is between one end of the first radiating portion away from the feed point and a first connecting point connected with the first inductive element and the first radiating portion, a fourth distance is between the first connecting point and the feed point, and the fourth distance is smaller than the third distance;

wherein a fifth distance is between one end of the second radiating portion away from the feed point and a second connecting point connected with the second inductive element and the second radiating portion, a sixth distance is between the second connecting point and the feed point, and the sixth distance is smaller than the fifth distance;

wherein the width of the first radiating portion and the second radiating portion is 0.5-1.5 mm, and the first distance and the second distance are 3-4 mm.

* * * * *